US005730854A

United States Patent [19]

Martin

[11] Patent Number: 5,730,854

[45] Date of Patent: Mar. 24, 1998

[54] ALKOXYLATED DIMERCAPTANS AS COPPER ADDITIVES AND DE-POLARIZING ADDITIVES

[75] Inventor: Sylvia Martin, Shelby Township, Mich.

[73] Assignee: Enthone-OMI, Inc., Warren, Mich.

[21] Appl. No.: 656,410

[22] Filed: May 30, 1996

[51] Int. Cl.[6] ..... C25D 3/38

[52] U.S. Cl. ..... 205/296; 205/239; 106/1.26

[58] Field of Search ..... 205/296, 298, 205/239; 106/1.26

[56] References Cited

U.S. PATENT DOCUMENTS

| | | | |
|---|---|---|---|
| 3,328,273 | 6/1967 | Creatz et al. | 204/52 |
| 3,502,551 | 3/1970 | Todt et al. | 204/52 |
| 3,743,584 | 7/1973 | Todt et al. | 204/52 R |
| 3,770,597 | 11/1973 | Tixier | 204/52 R |
| 3,770,598 | 11/1973 | Creutz | 204/52 R |
| 3,784,454 | 1/1974 | Lyde | 204/52 R |
| 3,985,784 | 10/1976 | Clauss et al. | 204/40 |
| 3,987,246 | 10/1976 | Zimmerman et al. | 76/165 |
| 4,110,176 | 8/1978 | Creutz et al. | 204/52 R |
| 4,272,335 | 6/1981 | Combs | 204/52 R |
| 4,292,155 | 9/1981 | Bosso et al. | 204/181 C |
| 4,336,114 | 6/1982 | Mayer et al. | 204/52 R |
| 4,347,108 | 8/1982 | Willis | 204/52 R |
| 4,376,685 | 3/1983 | Watson | 204/52 R |
| 4,683,036 | 7/1987 | Morrissey et al. | 204/15 |
| 4,861,438 | 8/1989 | Banks et al. | 204/15 |
| 5,151,170 | 9/1992 | Montgomery et al. | 205/298 |
| 5,200,057 | 4/1993 | Canaris | 205/313 |
| 5,219,523 | 6/1993 | Vanderpool et al. | 422/16 |
| 5,236,626 | 8/1993 | Vanderpool et al. | 252/394 |
| 5,238,554 | 8/1993 | Banks | 205/125 |
| 5,256,275 | 10/1993 | Brasch | 205/247 |
| 5,328,589 | 7/1994 | Martin | 205/296 |
| 5,417,841 | 5/1995 | Frisby | 205/296 |
| 5,425,873 | 6/1995 | Bladon et al. | 205/126 |
| 5,458,746 | 10/1995 | Burgess et al. | 204/186 |

OTHER PUBLICATIONS

"The Effect of Polyoxyethylene and Polyoxyethylene Thioether Compounds in Electroless Copper Solutions" by A. Molenaar et al, *Plating, Journal of the American Electroplaters' Society*, (Jul. 1974) pp. 649–653.

"The Effect of Some Surface Active Additives Upon the Quality of Cathodic Copper Deposits During the Electro–Refining Process" by Mirkova, Petkova, Popova & Rashkov, *Hydrometallurgy* 36 (1994) pp. 201–213.

*Primary Examiner*—Kathryn L. Gorgos
*Assistant Examiner*—Kishor Mayekar
*Attorney, Agent, or Firm*—Harness, Dickey & Pierce, P.L.C.

[57] ABSTRACT

A copper electroplating process using alkoxylated dimercaptan ethers as an additive. The additives prevent dendritic formations which short out electrodes. Also provided is a method for polarizing the electrodes, allowing for current reduction and cost savings.

20 Claims, No Drawings

ALKOXYLATED DIMERCAPTANS AS COPPER ADDITIVES AND DE-POLARIZING ADDITIVES

BACKGROUND OF THE INVENTION

The present invention relates to additives for producing brightened copper deposits which are substantially free of dendrite nodules and sulfur impurities. More specifically, in one aspect, the present invention relates to dimercaptan ether additives useful in electrorefining of a copper deposit. The additives of the present invention are also useful in copper electroplating for decorative and functional purposes such as electrical connections and circuit boards as well as in electrowinning applications. In another aspect, the present invention relates to a process for de-polarizing the electrodes for reducing current use and cost savings in electrorefining applications.

Commercial electrorefining of copper ore has been advantageous for use in refining of copper ore since the late 1800's. By this method, large quantities of very pure copper are deposited as a cathode from a bath which consists of an acid copper bath utilizing impure anodes. As might be expected, the acid bath contains substantial amounts of impurities after continued operation of the electrorefining process. These impurities are typically supplied by the breakdown of the impure anodes during operation. Typically, these impurities include bismuth, arsenic, ferrous sulfate, tellurium, selenium, silver, gold, and nickel. Because these baths are run in extremely large commercial quantities, problems in the electrorefining process typically result in extremely large quantities of either unacceptable copper deposits or extremely large reductions in process efficiencies. On the contrary, improvements in such processes typically result in extremely large gains in productivity and output. Thus, even a minor increase in the amount of current which can be applied across the electrodes greatly increases the total output of such an electrorefining plant.

In the past, there have been two ongoing problems with electrorefining baths. With the advent of computer technology and other uses for electrorefined copper, the purity standards have been increased. Additive chemistry presently in place in electrorefining baths is barely adequate to maintain the necessary purity levels. For instance, prior art additives which have been used in these baths have included glue and thiourea compounds. While these additives benefit the baths temporarily, such additives break down quickly and may complex with antimony, bismuth, nickel and/or arsenic which allows these impurities to be co-deposited along with nickels and arsenic in the copper plating product.

The second problem in the past is that as these glues and thioureas break down in the baths, dendritic copper begins to form on the cathodes. Eventually, these dendrites grow as nodules on the cathodes and short out the anode-cathode gap. Once these plates are shorted out, the particular plating on that electrode has ceased and the process has become less efficient. Thus, it has been desirable to provide a brightening additive in these baths which will attenuate dendrite formation and does not tend to complex with impurities in the baths or produce other undesirable results in the bath.

Additionally, de-polarizing agents are useful in electrorefining baths. In the past, sulfur-nitrogen materials (generally having the active sites $$-N-\underset{\underset{S}{\|}}{C}-)$$

are used for de-polarization in electrorefining baths. The disadvantage of these agents is that they tend to dimerize in a copper electrolyte and then complex with bath impurities such as arsenic, tin or bismuth. This ultimately results in co-depositing of these impurities into copper deposits, which is undesirable. Thus, it has been desirable to find a suitable replacement for these depolarization agents.

Sulfur-nitrogen compounds are also used for preventing dendrite growth. Such agents are shown in U.S. Pat. Nos. 4,376,683 or 5,151,170. While these materials work well to prevent dendritic formations in copper deposits, typically these additives may result in some plating out of sulfur as an impurity in the copper deposit as well as promoting co-deposition of other impurities, as noted above. This is undesirable in applications where purity of the copper deposit is critical. Such applications include electrical connection plating, plating of circuit boards and electrorefining operations. In such applications, sulfur is an impurity which must be avoided. Therefore, prior copper plating additives may not remedy the problems noted above.

Many of the additives which are available for bright copper are expensive and provide little flexibility as to the type of result which can be achieved. For instance, a jewelry grade satin copper finish cannot be obtained by conventional bright copper additives. Sulfur-free copper for electronic plating provides better conductivity.

Thus, also in the art to improve the electrorefining process, it has been a goal to find suitable additives for reducing dendritic formations, which do not create complexing problems or break down into undesirable impurities in the bath. Additionally, it has been a goal in the art to provide a copper additive which is less expensive, provides greater decorative options and which is suitable for plating pure copper without plating out sulfur.

It has also been a goal in the art to improve the efficiencies of these baths which results in cost savings in the electrorefining processes.

SUMMARY OF THE INVENTION

In accordance with the present invention, there is provided a method for electroplating of a copper deposit which is substantially free of dendrites, nodules and sulfur as an impurity. The process includes a step of first providing an electrorefining or electrowinning bath which includes at least an effective amount of ionic copper and an effective amount of an alkoxylated dimercaptan ether. Thereafter, a copper deposit is electroplated from the bath onto a cathode.

The dimercaptan ethers of the present invention have the advantage that the resulting copper deposit remains substantially free of dendrites which may short out the plating electrodes. The additives of the present invention also prevent formation of nodules and do not break down into complexing agents which would allow complexed materials to plate out from the solution. Additionally, the dimercaptan ethers of the present invention do not readily break down into compositions which are subject to co-depositing sulfur impurities into the copper deposit, yet are also effective for utilization in decorative applications if so desired.

Also in accordance with this invention, there is provided a method for de-polarization of electrodes in a copper electrorefining bath by including a soluble depolarizing additive in the bath. The additives provide de-polarization substantially without complexing or co-depositing of other impurities from the bath. The addition of the de-polarizing additive results in a reduction of current use and a cost savings in the electrorefining application.

DETAILED DESCRIPTION OF THE PREFERRED EMBODIMENT

In accordance with the present invention, there is provided a method for electroplating of a copper deposit which is substantially free of dendrites, nodules and sulfur as an impurity. The method comprises first providing an electroplating bath which includes ionic copper and an effective amount of an alkoxylated dimercaptan ether. Second, the copper deposit is electroplated onto a cathode to provide a copper deposit substantially free of dendrites, nodules and sulfur impurities.

In a first embodiment of the present invention, the dimercaptan ether is used as an additive in an electrorefining bath. The metal concentrations of electrorefining baths are known in the art and typically comprise a semi-refined copper ore material which is dissolved in a sulfuric acid bath. For such baths to be operational, typically, sulfuric acid in such solutions ranges from about 130 to about 225 grams per liter. Typically, for such a bath to be operational for electrorefining of copper the bath must contain from about 30 to about 60 grams per liter copper ion concentration typically from copper sulfate. Such baths typically contain chloride ions in ranges of from about 10 to about 75. Because these baths are typically obtained from raw copper ores or semi-refined copper ores the baths contain impurities found in such ores. These impurities include nickel ions, antimony ions, bismuth ions, arsenic ions, ferrous sulfate, tellurium ions, selenium ions, gold ions and silver ions. Amounts of these may vary substantially depending on the source of the ore.

Electrowinning baths typically contain sulfuric acid, copper and chloride ions in similar concentrations as electrorefining baths. However, electrowinning baths typically have lower concentration of copper than used in electrorefining operations.

Typically, such baths are prepared in large commercial quantities of from thousands to millions of gallons. Typically, the anodes and cathodes of such a bath are arranged such that they are about 2–5 inches apart with the copper bath flowing between them. As will be readily appreciated this distance narrows as plating from the bath continues. In the past the plating was accomplished at a cathode current density of from about 15 to about 18 amps per square foot (ASF). Typically, in the past the amount of current would require adjustment as the glue and thiourea varied in the solution. With the additives of the present invention the electrorefining process can be effectively run at currents of from about 15 to about 25 ASF, thus, allowing for more efficient operation of the bath. Similarly, electrowinning operable current densities are improved by the additives of the present invention.

In a second embodiment, the dimercaptan ether additives of the present invention are useful in decorative copper electroplating baths for decreasing cost and providing a bright copper satin plating for use in jewelry or the like. Decorative electroplating baths typically contain copper sulfate, sulfuric acid, chloride ions and organic brighteners. Functional copper plating applications such as used on circuit boards, electrical connections, strip plating, rod plating or other electronics plating can include the same constituents. Typically, the functional copper plating baths include higher acid and lower metal concentrations than decorative baths. Examples of decorative and functional copper plating baths in which additives of the present bath may be substituted for the additives therein are set forth in U.S. Pat. No. 4,272,335, issued to D. Combs on Jun. 9, 1981, entitled "Composition and Method for Electrodeposition of Copper" and U.S. Pat. No. 5,328,589, issued to S. Martin on Jul. 12, 1994, entitled "Functional Fluid Additives for Acid Copper Electroplating Baths" which are hereby incorporated herein by reference. By using the additives of the present invention in decorative copper plating baths, decorative jewelry grade copper can be realized. Additionally, this additive may be used as the sole brightening additive in the system rather than using a combination of brighteners which have been required in the past.

Additives of the present invention are selected from the group of alkoxylated dimercaptan ethers. Additives useful in the present invention have the general formula:

$$HO—R_1—[O—R_2]_n—S—Z—X—S—[R_3—O]_m—R_4—OH$$

wherein:

$R_1$, $R_2$, $R_3$ and $R_4$ are selected from the group consisting of ethylene, propylene and butylene;

Z is selected from the group consisting of $R_5—O—R_6$, $R_5—O—Y_1$, $Y_1—O—Y_2$, and $Y_1—Y_2$, where $R_5$ is selected from the group consisting of ethylene, propylene, $Y_1$, and $Y_2$;

$R_6$ is selected from the group consisting of ethylene, propylene, $Y_1$ and $Y_2$;

$Y_1$ is selected from the group consisting of R—OH and

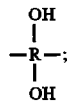

$Y_2$ is selected from the group consisting of R—OH and

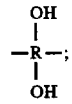

where R is selected from the group consisting of ethylene, propylene and butylene;

X is selected from the group consisting of $(O—R_5)_p$ where p=0 to 3; and m+n is generally from about 8 to about 100, and preferably is 8 to 40.

The moieties Z and X in the above formula are selected such that the sulfur groups are sufficiently separated to prevent the co-depositing of sulfur into the copper deposit. Preferably, Z, X, and m+n are selected such that the resulting compound is soluble in the bath. Typically, m+n is selected to be from about 8 to about 23 and preferably is selected to be from about 13 to about 16. Examples of preferred compositions useful as additives in the present invention include 1,11 dimercapto 3,5,9 trihydroxy 4,8 dioxa undecane with 16 moles polyethoxylate and 4 moles polypropoxylate. Examples of suitable additives include: 1,6 dimercapto-2,4 dioxahexane ethoxylated with 16 moles of ethylene oxide; 1,8 dimercapto-3,6 dioxaoctane ethoxylated with 16 moles of ethylene oxide; 1,4 dimercapto-2 oxabutane ethoxylated with 20 moles of ethylene oxide; 1,8 dimercapto-3,6-dioxa-octane alkoxylated with 2 moles butylene oxide, with 6 moles propylene oxide and 16 moles ethylene oxide.

The above additives are used in effective quantities in the bath for preventing dendritic formations in the resulting copper deposit on the cathode. Depending on the bath chemistry and current density parameters used, the additive of the present invention is used in amounts of generally from about 5 to about 1000 mg/l, typically from about 20 to about 200 mg/l and preferably from about 20 to about 120 mg/l. Typically, as the ASF current is increased more of the additive is necessary to achieve the desirable result. Also, higher levels of the additive are desirable when the bath includes higher levels of impurities.

It has been found that the above additive compositions are also useful for producing ductile fine grained copper deposits in other areas such as for decorative copper deposits. Typically, in such an application the amount used is less than about 60 mg/l. The additives are also useful in functional electrical copper baths when used in amounts of from about 60 to about 700 mg/l.

it is within the scope of the present invention that the additives may be used alone or in combination with other known additives. The additives of the present invention are advantageous in that they provide properties of improving ductility and inhibiting dendrite formation which is typically accomplished by other sulfur containing additives, but in this case compounds of the present invention, do not co-deposit sulfur in the copper deposit. This is critical in electrorefining operations and in uses of the copper plating in electronics applications. Additionally, the additives of the present invention do not break down into harmful by-products which could cause complexing and co-depositing of other metals in the copper deposit. The additives of the present invention have the advantage that they will break down into carbon dioxide and sulfates. These byproducts are known to be compatible with the bath.

In a further aspect, a particularly useful additive in electrorefining baths is a depolarizing additive having the formula:

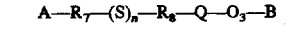

$$A—R_7—(S)_n—R_8—Q—O_3—B$$

wherein:

$R_7$ and $R_8$ are alkylene groups having 1–6 carbons;

A is selected from H, an acid sulfonate or phosphonate, an alkali metal sulphonate or phosphonate, an ammonium salt sulfonate or phosphonate, or an alkali substituent;

B is selected from H, a group I or group II metal ion or an ammonium ion;

n=1–3; and

Q is either sulfur or phosphorous.

Such additives are useful either alone or in combination with the above dimercaptans to provide improvements in electrorefining applications. Particularly, additives of the above formula are useful as de-polarizing agents in electrorefining baths. These additives reduce current consumption to provide large cost savings in large scale electrorefining operations. These additives provide de-polarization substantially without complexing or co-depositing of other impurities from the bath. These additives are useful in ranges of from 0.01 to 25 mg/l. Thus, requirements for these materials are very low, which make them economical in electrorefining applications.

Examples of suitable de-polarization additives include:

$HO_3P—(CH_2)_3—S—S—(CH_2)_3—PO_3H$;

$HO_3S—(CH_2)_4—S—S(CH_2)_4—SO_3H$;

$NaO_3S—(CH_2)_3—S—S—(CH_2)_3—SO_3Na$;

$HO_3S—(CH_2)_2—S—S(CH_2)_2—SO_3H$;

$CH_3—S—S—CH_2—SO_3H$;

$NaO_3—(CH_2)_3—S—S—S—(CH_2)_3—SO_3Na$; and $(CH_2)_2—CH—S—S—(CH_2)_2—SO_3H$.

Further understanding of the present invention will be realized from the following examples set forth herein for purposes of illustration but not limitation.

EXAMPLE 1

An electrorefining electrolyte was analyzed to contain the following chemistry:

| Constituent | Amount |
|---|---|
| copper sulfate | 187.5 g/l |
| sulfuric acid | 150 g/l |
| chloride ion | 30 mg/l |
| nickel ion | 15 g/l |
| antimony ion | 400 mg/l |
| bismuth ion | 200 mg/l |
| arsenic ion | 3.75 mg/l |
| ferrous sulfate | 37.5 g/l |
| tellurium ion | 100 mg/l |
| selenium ion | 300 mg/l |
| silver and gold* | |

*present in anode slimes

An ethoxylated dithiolether (1,6 dimercapto 2,4 dioxahexane ethoxylated with 16 moles of ethoxy groups) was added to the bath in a quantity of 20 mg/l. The bath is maintained at a temperature of about 150° F. A copper cathode is plated at 25 ASF for two weeks. No agitation is given to the bath other than that created by allowing the bath to flow through between the electrodes. The resulting deposit was uniform, satin copper colored, fine grained and had no dendrites or nodules. The deposit was pure and had no undesired co-deposition products.

EXAMPLE 2

As an example of a decorative application, a decorative copper plating bath is prepared as follows:

| Constituent | Amount |
|---|---|
| copper sulfate | 180 g/l |
| sulfuric acid | 75 g/l |
| chloride ion | 70 ppm |
| ethoxylated dithiolether* | 15 ppm |

*1,8 Dimercapto-3,6 dioxaoctane ethoxylated with 16 moles of ethylene oxide

The deposit was plated on a brass substrate at 40 ASF with air agitation to a 0.5 mil thickness. The temperature was 75° F. The copper was uniform and semi-bright from high to low current density. The copper was exceptionally ductile and decorative looking. The semi-bright appearance gave it rich color for decorative applications.

EXAMPLE 3

As an example of an electrical plating application, a plating bath was prepared as follows:

| Constituent | Amount |
|---|---|
| copper sulfate | 67.5 g/l |
| sulfuric acid | 172.5 g/l |
| chloride ion | 65 ppm |
| ethoxylated dithiolether* | 20 ppm |

*1,4 dimercapto-2 oxabutane ethoxylated with 20 moles of ethylene oxide

A circuit board was plated at 20 ASF to 1 mil thickness with a cathode rod and air agitation. The bath temperature was 80° F. The copper was uniform, semi-bright and very ductile, and pure with good distribution.

EXAMPLE 4

The following example is a comparative one, demonstrating the effectiveness of the present invention in an all-oxygen containing polyether polyoxyl vs. ethoxylated dimercaptan oxabutane added as additives to a copper electrorefining bath:

Typical copper sulfate electrorefining electrolyte:

| Constituent | Amount |
|---|---|
| copper metal | 45 g/l |
| sulfuric acid | 167 g/l |
| chloride | 30 mg/l |
| nickel | 7.5–20.25 g/l |
| antimony | 200–700 mg/l |
| bismuth | 100–500 mg/l |
| arsenic | 1.875–12 g/l |
| iron | 200–2000 mg/l |
| selenium | –500 mg/l |
| tellurium | –100 mg/l |
| Temperature 140° F.–160° F. | |
| Cathode Current Density 22 ASF | |
| typical impure copper anodes to be purified | |

To each of two electroplating cells are added (a) 60 ppm polyoxyethylene and to the other (b) 60 ppm dimercaptoether ethoxylate. The electrolysis takes place with 2 crude anodes and a pure copper cathode in close proximity for at least 6 hours. The cathode of (a) has large-grained, dark red colored crystals and is rough, with significant dendrite deposits over at least 80% of the cathode surface. The cathode of (b) is finely crystalline, light colored, and smooth with no dendritic growth on the cathode surface. The deposit of (b) when analyzed, is found to contain essentially no sulfur co-deposition.

EXAMPLE 5

An electrowinning bath is analyzed which contains the following:

| Constituent | Amount |
|---|---|
| copper metal | 35.25–50.25 g/l |
| $H_2SO_4$ | 180 g/l |
| chloride ion | 35–40 mg/l |
| cobalt | 50–100 mg/l |
| manganese | 1,000 mg/l max |
| iron | 1,000–3,000 mg/l |
| calcium | 50–300 mg/l |

To this bath is added from about 15–75 mg/l of additives of the present invention. The electrowinning process is conducted at an ASF of from about 10 to about 20. Improved copper products are produced by the process.

Examples 6–11 set forth below further illustrate examples of the de-polarizing agent of the present invention used in electrorefining baths.

EXAMPLE 6

An electrorefining electrolyte of the general formula set forth below is used for Examples 6–11.

| Constituent | Amount |
|---|---|
| copper metal | 6 oz/g |
| sulfuric acid | 22 oz/g |
| chloride | 30 ppm |
| nickel | 1–2.7 oz/g |
| antimony | 200–700 ppm |
| bismuth | 100–500 ppm |
| arsenic | 0.25–1.6 oz/g |
| iron | 200–2,000 ppm |
| selenium | ~500 ppm |
| tellurium | ~100 ppm |
| Temperature 140° F.–160° F. | |
| Cathode Current Density 18–25 ASF | |

To the electrolyte above is added 10 ppm of di (sodium sulfonate propane sulfide). The bath is operated at 22 to about 25 ASF and at a temperature of about 150° F. There is significant reduction of nodules and dendrites, and the copper shows a fine crystalline structure and is not contaminated with sulfur in the deposit. The production increases by 1%.

EXAMPLE 7

To the electrolyte in Example 6 above is added 30 ppm of poly oxy ethylene (MW 4000). The bath is operated at from about 22 to about 25 ASF and at a temperature of about 150° F. The cooperation of the two additives gives fine-grained pure copper with a production increase of 2%. There are no dendrites or nodules.

EXAMPLE 8

To the electrolyte in Example 6 above are added 60 mg/l ethoxylated 1,8 dimercapto 3,6 dioxaoctane. The bath is operated at about 22 to about 25 ASF and at a temperature of about 150° F. The deposit is very smooth, extra fine-grained, and shows good color. There are no dendrites or nodules, and production increases by 6% efficiency.

EXAMPLE 9

To the electrolyte in Example 6 above are added 8 ppm of bone glue or 8 ppm of gelatine. The bath is operated at about 22 to about 25 ASF and at a temperature of about 150° F. The cooperation of both additives produces fine-grained, smooth copper deposits with a 2% increase in production.

EXAMPLE 10

To the electrolyte for copper electrorefining is added 15 mg/l di (potassium sulfonate ethyl sulfide). The bath is operated at about 20 ASF and at a temperature of about 160° F. There is significant reduction in roughness, nodules and dendrites, with a 1% increase in production efficiency.

EXAMPLE 11

To the electrolyte for copper electrorefining is added 5 mg/l di (phosphonic acid propyl sulfide). The bath is operated at about 18 ASF and at a temperature of about 155° F. There is a significant reduction in roughness and nodules, with an increase in fine-grained copper deposits. There is a 0.5% increase in production efficiency.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for electroplating a copper deposit substantially free of dendrites, nodules and sulfur impurities, comprising:

(1) providing an electroplating bath including ionic copper and an effective amount of an alkoxylated dimercaptan ether additive for inhibiting formation of dendrites and nodules, and reducing sulfur impurities; and (2) electroplating a copper deposit from said bath onto a cathode, wherein the resulting deposit is substantially free of dendrites, nodules and sulfur impurities.

2. The method of claim 1 wherein said dimercaptan ether has the formula:

$$HO—R_1—[O—R_2]_n—S—Z—X—S—[R_3—O]_m—R_4—OH$$

wherein:

$R_1$, $R_2$, $R_3$ and $R_4$ are selected from the group consisting of ethylene, propylene and butylene;

Z is selected from the group consisting of $R_5—O—R_6$, $R_5—O—Y_1$, $Y_1—O—Y_2$ and $Y_1—Y_2$, where $R_5$ is selected from the group consisting of ethylene, propylene, $Y_1$ and $Y_2$.

$R_6$ is selected from the group consisting of ethylene, propylene, $Y_1$ and $Y_2$;

$Y_1$ is selected from the group consisting of R—OH and

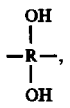

$Y_2$ is selected from the group consisting of R—OH and

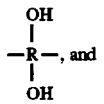

where R is selected from the group consisting of ethylene, propylene and butylene;

X is selected from the group consisting of $(O—R_5)_p$ where p=0 to 3; and m+n is from about 8 to about 100.

3. The method of claim 2 wherein m+n is from about 8 to about 23.

4. The method of claim 2 wherein m+n is from about 13 to about 16.

5. The method of claim 2 wherein said additive is present in said bath in quantities of from about 5 to about 1000 mg/l.

6. The method of claim 2 wherein said additive is present in said bath in amounts of from about 20 to about 120 mg/l.

7. The method of claim 2 wherein a ductile bright satin copper deposit is plated by including from about 0.5 mg/l to about 60 mg/l of said additive in said bath.

8. The method of claim 2 wherein a functionally pure electrical grade copper plate is produced wherein the additive is found in the bath in an amount of from about 60 to about 1000 mg/l.

9. The method of claim 2 wherein said copper electroplating is an electrowinning process wherein the additive is found in the bath in an amount of from about 10 to about 300 mg/l.

10. The method of claim 1 wherein the additive is selected from the group consisting of: 1,6 dimercapto-2,4 dioxahexane ethoxylated with 16 moles of ethylene oxide; 1,8 dimercapto-3,6 dioxaoctane ethoxylated with 16 moles of ethylene oxide; 1,4 dimercapto-2 oxabutane ethoxylated with 20 moles of ethylene oxide; 1,11, dimercapto-3,5,9-trihydroxy-4,8 dioxa-undecane ethoxylated with 4 moles propylene oxide and 16 moles ethylene oxide; and 1,8 dimercapto-3,6 dioxa-octane alkoxylated with 2 moles butylene oxide 6 moles propylene oxide and 16 moles ethylene oxide.

11. A method for electrorefining a fine-grained copper deposit substantially free of dendrites and nodules comprising:

(1) providing a bath for electrorefining of a copper material, the bath including ionic copper and an effective amount of an alkoxylated dimercaptan ether additive for inhibiting formation of dendrites and nodules, and reducing sulfur impurities, and allowing said bath to be passed between a cathode and anode for deposition of a copper deposit on the cathode; and (2) providing an electroplating current to said anode and cathode for depositing a substantially sulfurfree copper deposit on said cathode.

12. The method of claim 8 wherein the additive has the formula:

$$HO—R_1—[O—R_2]_n—S—Z—X—S—[R_3—O]_m—R_4—OH$$

wherein:

$R_1$, $R_2$, $R_3$ and $R_4$ are selected from the group consisting of ethylene, propylene and butylene;

Z is selected from the group consisting of $R_6—O—R_6$, $R_5—O—Y_1$, $Y_1—O—Y_2$ and $Y_1—R_2$, where $R_5$ is selected from the group consisting of ethylene, propylene, $Y_1$ and $Y_2$.

$R_6$ is selected from the group consisting of ethylene, propylene, $Y_1$ and $Y_2$;

$Y_1$ is selected from the group consisting of R—OH and

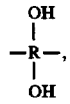

$Y_2$ is selected from the group consisting of R—OH and

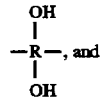

where R is selected from the group consisting of ethylene, propylene and butylene;

X is selected from the group consisting of $(O—R_5)_p$ where p=0 to 3; and m+n is from about 8 to about 100.

13. The method of claim 12 wherein the additive is selected from the group consisting of: 1,6 dimercapto-2,4 dioxahexane ethoxylated with 16 moles of ethylene oxide; 1,8 dimercapto-3,6 dioxaoctane ethoxylated with 16 moles of ethylene oxide; 14 dimercapto-2 oxabutane ethoxylated with 20 moles of ethylene oxide; 1,11, dimercapto-3,5,9-trihydroxy-4,8 dioxa-undecane ethoxylated with 4 moles propylene oxide and 16 moles ethylene oxide; and 1,8 dimercapto-3,6 dioxa-octane alkoxylated with 2 moles butylene oxide 6 moles propylene oxide and 16 moles ethylene oxide.

14. The method of claim 12 wherein m+n is from about 8 to about 23.

15. The method of claim 12 wherein m+n is from about 13 to about 16.

16. The method of claim 12 wherein the additive is used in amounts of from about 5 to about 1000 mg/l.

17. The method of claim 12 wherein said additive is present in amounts of from about 20 to about 200 mg/l.

18. The method of claim 12 wherein the bath further comprises a de-polarizing additive having the formula:

$$A—R_7—(S)_n—R_6—Q—O_3B$$

wherein:

$R_7$ and $R_6$ are alkylene groups having from about 1 to about 6 carbons;

A is selected from the group consisting of hydrogen, sulfonate, phosphonate, an alkaline metal sulfonate or phosphonate, an ammonium salt of a sulfonate or phosphonate, an acid of a sulfonate or phosphonate, and an alkali;

n=1–3;

B is selected from the group consisting of H, a group I or group II metal ion and an ammonium ion; and Q is selected from S or P.

19. The method of claim 18 wherein the depolarizing additive is used in amounts of from about 0.01 to about 25 mg/l.

20. The method of claim 18 wherein the additive is selected from the group consisting of:

$HO_3P—(CH_2)_3—S—S—(CH_2)_3—PO_3H$;

$HO_3S—(CH_2)_4—S—S(CH_2)_4—SO_3H$;

$NaO_3S—(CH_2)_3—S—S—(CH_2)_3—SO_3Na$;

$HO_3S—(CH_2)_2—S—S(CH_2)_2—SO_3H$;

$CH_3—S—S—CH_2—SO_3H$;

$NaO_3—(CH_2)_3—S—S—S—(CH_2)_3—SO_3Na$;

$(CH_2)_2—CH—S—S—(CH_2)_2—SO_3H$; and mixtures thereof.

* * * * *

UNITED STATES PATENT AND TRADEMARK OFFICE

CERTIFICATE OF CORRECTION

PATENT NO. : 5,730,854

DATED : March 24, 1998

INVENTOR(S) : Sylvia Martin

It is certified that error appears in the above-identified patent and that said Letters Patent is hereby corrected as shown below:

Column 5, Line 22, "it" should be --It--.

Column 5, Line 37, "byproducts" should be --by-products--.

Column 9, Line 32, Claim 2, "$Y_2$." should be --$Y_2$;--.

Column 9, Line 39, Claim 2, "," should be --;--.

Column 9, Line 47, Claim 2, ", and" should be --;--.

Column 10, Line 42, Claim 12, "$R_6$" should be --$R_5$--.

Column 10, Line 43, Claim 12, "$R_2$" should be --$Y_2$--.

Column 10, Line 45, Claim 12, "$Y_2$." should be --$Y_2$;--.

Column 10, Line 52, Claim 12, "," should be --;--.

Column 10, Line 61, Claim 12, ", and" should be --;--.

UNITED STATES PATENT AND TRADEMARK OFFICE

CERTIFICATE OF CORRECTION

PATENT NO. : 5,730,854 Sheet 2 of 2

DATED : March 24, 1998

INVENTOR(S) : Sylvia Martin

It is certified that error appears in the above-identified patent and that said Letters Patent is hereby corrected as shown below:

Column 11, Line 8, Claim 13, "14" should be --1,4--.

Column 11, Line 26, Claim 18, "$R_6$" should be --$R_8$--.

Column 12, Line 1, Claim 18, "$R_6$" should be --$R_8$--.

Signed and Sealed this

Twenty-fifth Day of August, 1998

Bruce Lehman

*Attest:*

BRUCE LEHMAN

*Attesting Officer*

*Commissioner of Patents and Trademarks*